US008620167B2

(12) United States Patent
Suzuki

(10) Patent No.: US 8,620,167 B2
(45) Date of Patent: Dec. 31, 2013

(54) IMAGE FORMING DEVICE HAVING A PLURALITY OF IMAGE FORMING MODES

(75) Inventor: Satoru Suzuki, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 358 days.

(21) Appl. No.: 13/043,325

(22) Filed: Mar. 8, 2011

(65) Prior Publication Data

US 2011/0280591 A1 Nov. 17, 2011

(30) Foreign Application Priority Data

May 14, 2010 (JP) ..... 2010-111808

(51) Int. Cl.
*G03G 15/08* (2006.01)

(52) U.S. Cl.
USPC ..... 399/27; 399/25; 399/288; 399/120

(58) Field of Classification Search
USPC ..... 399/27, 25, 62, 255, 288, 120
See application file for complete search history.

(56) References Cited

U.S. PATENT DOCUMENTS

| | | | | |
|---|---|---|---|---|
| 6,256,471 | B1 | 7/2001 | Sato et al. | |
| 7,146,115 | B2 * | 12/2006 | Suzuki et al. | 399/27 |
| 7,505,699 | B2 * | 3/2009 | Harada et al. | 399/27 |
| 2001/0026692 | A1 * | 10/2001 | Miura et al. | 399/27 |
| 2001/0050706 | A1 | 12/2001 | Ishii | |

FOREIGN PATENT DOCUMENTS

| | | | |
|---|---|---|---|
| JP | 2000-275948 | A | 10/2000 |
| JP | 2000-347494 | A | 12/2000 |
| JP | 2000-356901 | A | 12/2000 |
| JP | 2001-350339 | A | 12/2001 |
| JP | 2003-241500 | A | 8/2003 |
| JP | 2007-057732 | A | 3/2007 |

OTHER PUBLICATIONS

Japan Patent Office, Office Action for Japanese Patent Application No. 2010-111808 (counterpart to above-captioned patent application), mailed Apr. 24, 2012.

* cited by examiner

*Primary Examiner* — Walter L Lindsay, Jr.
*Assistant Examiner* — Roy Y Yi
(74) *Attorney, Agent, or Firm* — Baker Botts L.L.P.

(57) ABSTRACT

An image forming device includes a light-receiving element that receives a light having passed through a cartridge. An image forming unit has a first mode for forming images while rotating an agitator at a first speed and a second mode for forming images while rotating the agitator at a second speed that is lower than the first speed. If a value regarding image forming amount counted while the image forming unit is in the second mode is determined to be greater than a predetermined value, the image forming unit changes a rotation speed of the agitator from the second speed to the first speed, and it is determined whether the cartridge should be replaced based on a time ratio, which is a ratio of time duration, in which the light-receiving element receives the detection light within a predetermined duration, to the predetermined time duration.

20 Claims, 10 Drawing Sheets

IMAGE FORMING DEVICE HAVING A PLURALITY OF IMAGE FORMING MODES

CROSS REFERENCE TO RELATED APPLICATION

This application claims priority from Japanese Patent Application No. 2010-111808 filed May 14, 2010. The entire content of this priority application is incorporated herein by reference.

TECHNICAL FIELD

The present invention relates to an image forming device having a cartridge detachably mounted on a main casing.

BACKGROUND

There has been known an electrophotographic image forming device that includes a detachable cartridge having an agitator for agitating toner and that forms images by supplying toner accommodated in the cartridge to a photosensitive drum. In this type of image forming device, a remaining toner amount in the cartridge may be estimated based on a light-receiving signal obtained by detecting a light that has passed through windows on both side walls of the cartridge, and replacement time of the cartridge may be determined based on the estimated toner amount.

Some type of image forming device has a normal mode in which images are formed on such normal recording sheets as plain paper sheets and a low-speed mode in which images are formed on envelops, thick sheets, or the like, with the photosensitive drum and the like rotating slower than in the normal mode. The photosensitive drum, the agitator, and the like of the image forming device are configured to drive in conjunction with one another. Thus, when the rotation speed of the photosensitive drum is increased, then the rotation speed of the agitator also increases. When the rotation speed of the photosensitive drum is lowered, on the other hand, then the rotation speed of the agitator also decreases.

SUMMARY

However, the light-receiving signals vary depending on the mode (rotation speed of the agitator) even when the same amount of toner remains in the cartridge. Thus, it is conceivable to set different threshold values for each mode and to determine the replacement time of the cartridge based on the threshold value corresponding to the current mode.

However, in this configuration, a remaining toner amount at which the replacement time of the cartridge is determined based on a threshold value set for the normal mode may differ from what is determined based on a threshold value set for the low-speed mode. In this case, toner remaining in the cartridge may be wasted without being used.

In view of the foregoing, it is an object of the invention to provide an image forming device that has a plurality of different image forming modes and that can avoid waste of developer accommodated in a cartridge.

In order to attain the above and other objects, the invention provides an image forming device including a main casing, a cartridge detachably accommodated in the main casing and including an agitator that rotates to agitate developer accommodated in the cartridge, a light-emitting element that emits a light into the cartridge, a light-receiving element that receives the light that has passed through the cartridge, a calculating unit that calculates a time ratio, which is a ratio of time duration, in which the light-receiving element receives the detection light within a predetermined duration, to the predetermined time duration, a determining unit that determines whether the time ratio calculated by the calculating unit is greater than a first threshold value, an image forming unit, a counting unit, and a detection process executing unit. The determining unit determines that the cartridge should be replaced when the time ratio calculated by the calculating unit is determined to be greater than the first threshold value. The image forming unit has a first image forming mode for forming images on a recording sheet while rotating the agitator at a first rotation speed and a second image forming mode for forming images on a recording sheet while rotating the agitator at a second rotation speed that is lower than the first rotation speed. The counting unit counts a second value regarding image forming amount when the image forming unit is in the second image forming mode. The detection process executing unit determines whether the second value is greater than a predetermined count value while the image forming unit is in the second image forming mode, and executes a detection process if the second value is determined to be greater than the predetermined count value while the image forming unit is in the second image forming mode. In the detection process, the detection process executing unit controls the image forming unit to change a rotation speed of the agitator from the second rotation speed to the first rotation speed, and controls the determining unit to determine whether the cartridge should be replaced while the agitator is rotating at the first rotation speed.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
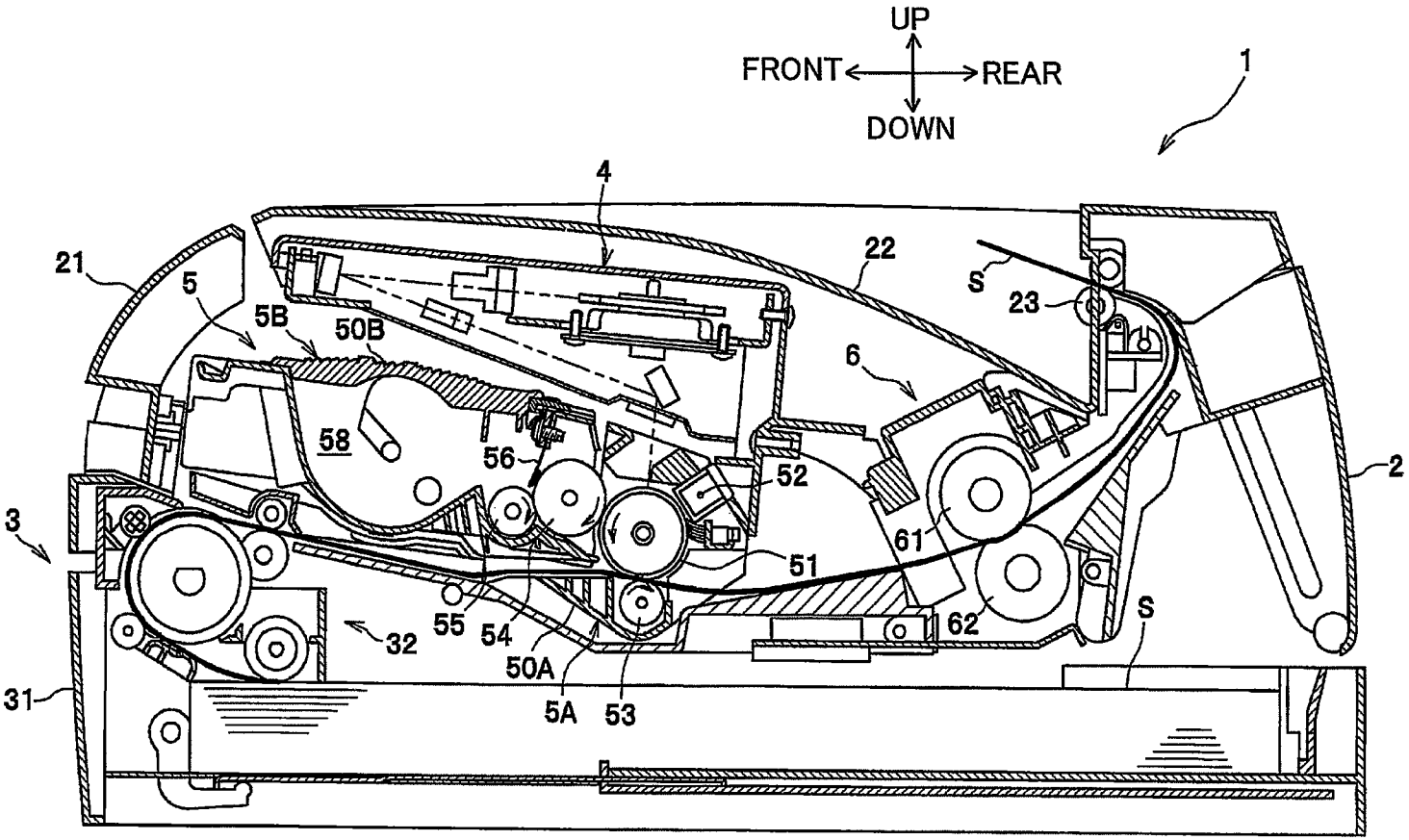
FIG. 1 is a cross-sectional side view of a laser printer as an image forming device according to a first embodiment of the invention.

Image forming devices according to embodiments of the invention will be described while referring to the accompanying drawings wherein like parts and components are designated by the same reference numerals to avoid duplicating description.

The terms "upper," "lower," "right," "left," "front," "rear" and the like will be used throughout the description assuming that the image forming device is disposed in an orientation in which it is intended to be used. In use, the image forming device is disposed as shown in FIG. 1. Also, the left and right sides of the image forming device will be based on the perspective of a user looking at the image forming device from the front side. In other words, the near side in FIG. 1 will be the "right side," while the far side in FIG. 1 will be the "left side."

<First Embodiment>

As shown in FIG. 1, a laser printer 1 as an image forming device according to a first embodiment of the invention includes a main casing 2 having a front cover 21 and, within the main casing 2, a sheet supply unit 3 for supplying a paper sheet (recoding sheet) S, an exposing unit 4, a process unit 5 for transferring toner images onto the paper sheet S, and a fixing unit 6 for thermally fixing the toner images onto the paper sheet S.

The sheet supply unit 3 is disposed in the lower section of the main casing 2, and includes a sheet supply tray 31 and a sheet supply mechanism 32. Paper sheets S accommodated in the sheet supply tray 31 are conveyed one sheet at a time toward the process unit 5 (a position between a photosensitive drum 51 and a transfer roller 53 to be described later) by the sheet supply mechanism 32.

The exposing unit 4 is disposed in the upper section of the main casing 2, and includes a light source (not shown), a polygon mirror, a plurality of lenses, and a plurality of reflection mirrors. A laser light emitted from the light source based on image data follows a pathway indicated by a two-dotted chain line and scans a surface of the photosensitive drum 51 at high speed.

The process unit (process cartridge) 5 is disposed below the exposing unit 4 and can be replaced by being detached from the main casing 2 through an opening formed in the main casing 2 that can be exposed when the front cover 21 is open. The process unit 5 includes a photosensitive unit 5A and a developing cartridge 5B.

The photosensitive unit 5A has a photosensitive frame 50A and, within the photosensitive frame 50A, the photosensitive drum 51, a charger 52, and the transfer roller 53.

The developing cartridge 5B is detachably mounted on the photosensitive unit 5A and is replaceable. The developing cartridge 5B includes a developing frame 50B and, within the developing frame 50B, a developing roller 54, a supply roller 55, and a thickness-regulation blade 56. The developing frame 50B defines a toner chamber 58 for accommodating toner T (see FIG. 2) as developer.

In the process unit 5, the charger 52 uniformly charges the surface of the photosensitive drum 51 as the photosensitive drum 51 rotates, and then the surface of the photosensitive drum 51 is exposed to the high-speed scanning of the laser light emitted from the exposing unit 4. As a result, an electrostatic latent image corresponding to the image data is formed on the surface of the photosensitive drum 51. The toner T accommodated in the toner chamber 58 is supplied to the developing roller 54 by the supply roller 55, enters between the developing roller 54 and the thickness-regulation blade 56, and then is held on the developing roller 54 as a toner layer with a thin uniform thickness.

The toner T held on the developing roller 54 is selectively supplied to the electrostatic latent image on the photosensitive drum 51, thereby forming a visible toner image on the photosensitive drum 51. Then, as the paper sheet S supplied from the sheet supply unit 3 passes through the position between the photosensitive drum 51 and the transfer roller 53, the toner image on the photosensitive drum 51 is transferred onto the paper sheet S.

The fixing unit 6 is disposed rearward of the process unit 5, and includes a heat roller 61 and a pressure roller 62 that sandwich the paper sheet S therebetween. The toner image transferred onto the paper sheet S is thermally fixed onto the paper sheet S as the paper sheet S passes between a position between the heat roller 61 and the pressure roller 62. The paper sheet S with the toner image fixed thereon is discharged from the fixing unit 6 and then discharged onto a discharge tray 22 by a discharge roller 23.

Figure 2:
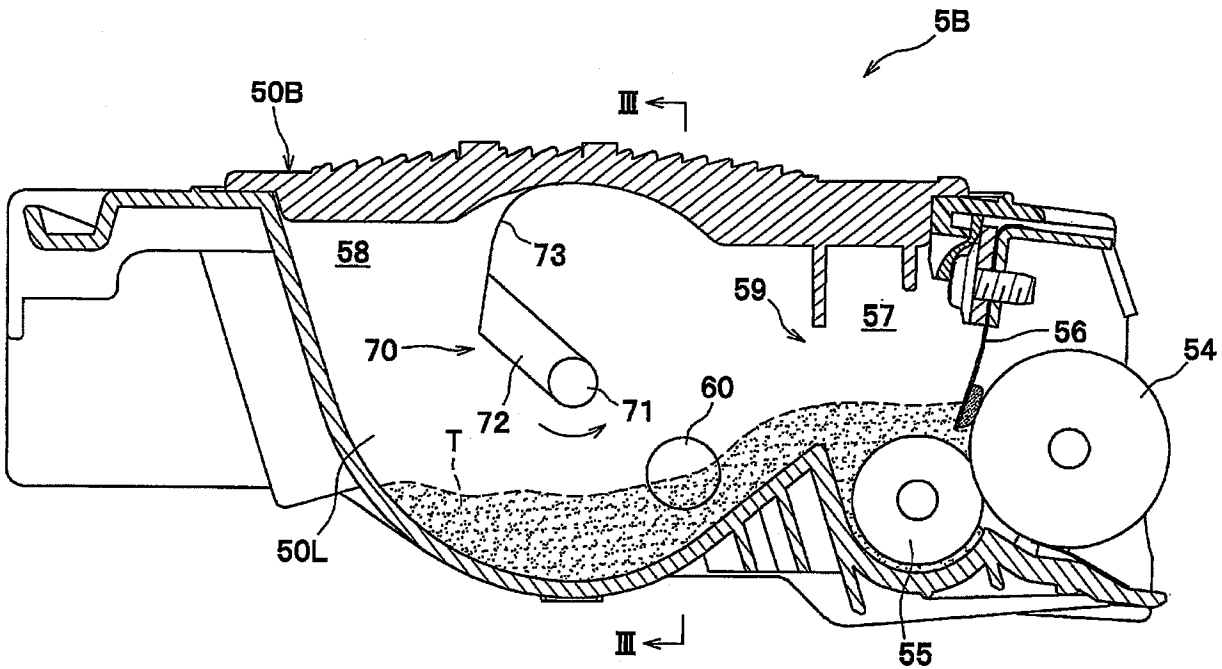
FIG. 2 is a cross-sectional side view of a developing cartridge of the laser printer shown in FIG. 1.

The configuration of the developing cartridge 5B will be described in greater detail. As shown in FIG. 2, the developing cartridge 5B has a developing chamber 57 and the toner chamber 58 both defined in the developing frame 50B. The developing chamber 57 accommodates the supply roller 55 and the like, and the toner chamber 58 accommodates the toner T. The developing cartridge 5B further includes an agitator 70 disposed within the toner chamber 58. Rotation of the agitator 70 agitates and conveys the toner T.

Figure 3:
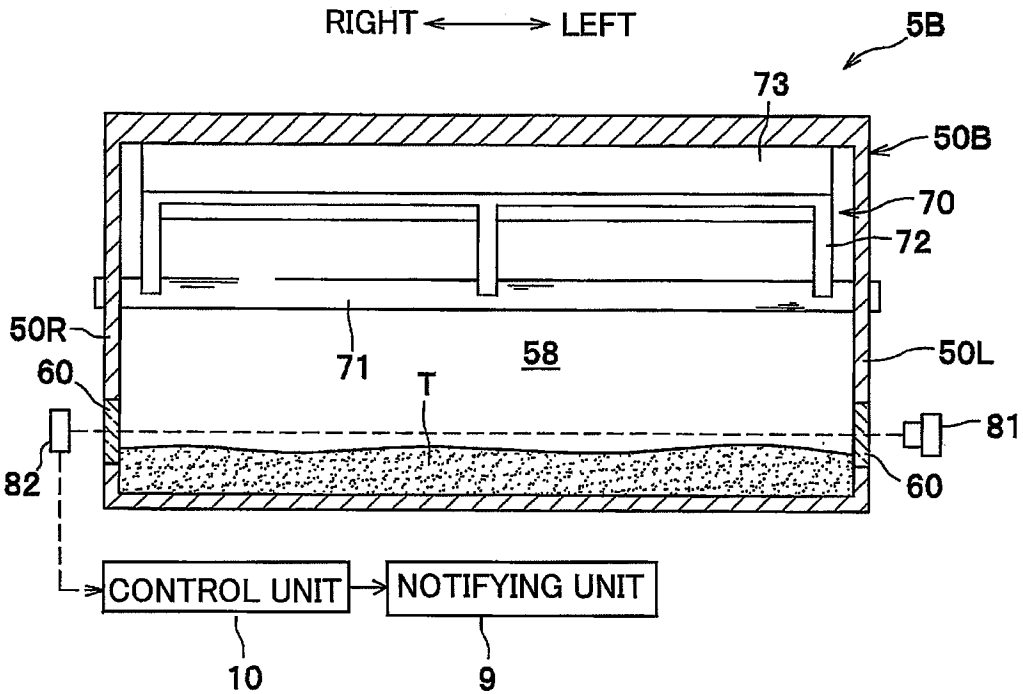
FIG. 3 is a cross-sectional view taken along a line III-III of FIG. 2, showing a configuration of and around the developing cartridge.

The developing chamber 57 and the toner chamber 58 are in fluid communication with each other via a communication port 59, and the toner T can be conveyed back and forth between the developing chamber 57 and the toner chamber 58 through the communication port 59. As shown in FIG. 3, the developing frame 50B has a left side plate SOL and a right side plate 50R, and windows 60 are disposed one on either of the left side plate SOL and the right side plate 50R. The windows 60 are opposite to each other with respect to a right-left direction.

The agitator 70 has a rotary shaft 71, an attachment 72 extending from the rotary shaft 71, and a flexible sheet member 73 fixed to a distal end of the attachment 72 by paste or the like. The agitator 70 rotates counterclockwise in a right-side view as indicated by an arrow in FIG. 2 when a rotary driving force is applied to the rotary shaft 71 from a motor (not shown) disposed in the main casing 2.

When the agitator 70 rotates, the sheet member 73 agitates and supplies the toner T toward the developing chamber 57 as a tip end of the sheet member 73 slides on a bottom wall or the like of the toner chamber 58. Note that the agitator 70 is configured to rotate together with the photosensitive drum 51 and the developing roller 54 upon supplied with the rotary driving force. Thus, when the rotation speed of the photosensitive drum 51 and the like is increased, then the rotation speed of the agitator 70 is also increased. When the rotation speed of the photosensitive drum 51 and the like is decreased, on the other hand, then the rotation speed of the agitator 70 is also decreased.

As shown in FIG. 3, the laser printer 1 also includes, within the main casing 2, a light-emitting element 81, a light-receiving element 82, a control unit 10, and a notifying unit 9. The control unit 10 controls the operation of the laser printer 1 and also determines the replacement time of the developing cartridge 5B. The notifying unit 9 is for notifying a user of a message.

The light-emitting element 81 and the light-receiving element 82 are disposed opposite to each other with the pair of windows 60 interposed therebetween. The light-emitting element 81 and the light-receiving element 82 can be configured of a well-known optical sensor.

The light-emitting element 81 emits a detection light into the toner chamber 58 of the developing cartridge 5B through one of the windows 60. When the amount of the toner T remaining in the developing cartridge 5B is equal to or less than a predetermined amount, then the detection light emitted from the light-emitting element 81 into the developing cartridge 5B passes through the developing cartridge 5B (the toner chamber 58) and the other window 60 and reaches the light-receiving element 82 as indicated by a dotted chain line. Upon receiving the detection light, the light-receiving element 82 outputs a light-receiving signal to the control unit 10.

When the amount toner T remaining in the developing cartridge 5B is greater than the predetermined amount (when there is sufficient amount of toner T in the developing cartridge 5B), then the detection light emitted from the light-emitting element 81 into the developing cartridge 5B is blocked by the toner T and thus cannot reach the light-receiving element 82. Accordingly, the light-receiving element 82 not receiving the detection light does not output the light-receiving signal.

Figure 4:
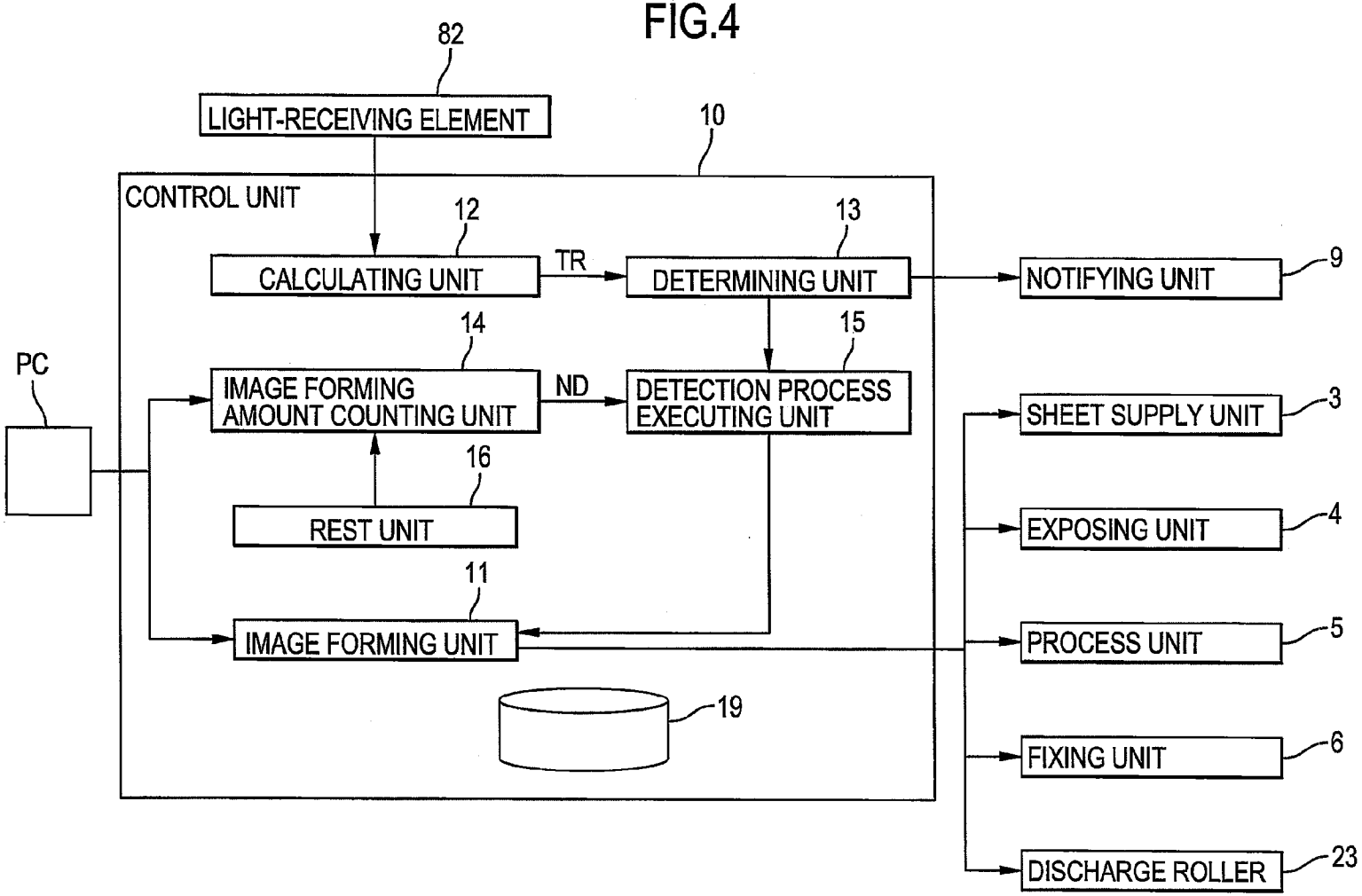
FIG. 4 is a block diagram of the laser printer of FIG. 1.

The control unit 10 is disposed at an appropriate position within the main casing 2, and as shown in FIG. 4, the control unit 10 includes an image forming unit 11, a calculating unit 12, a determining unit 13, an image forming amount counting unit 14, a detection process executing unit 15, and a rest unit 16. The control unit 10 includes a CPU, a RAM, a ROM, an input/output interface, and a memory 19 storing various programs. The control unit 10 realizes (functions as) these units 12, 13, 14, 15, and 16 by receiving information included in image data transmitted from such a device as a personal computer (PC) that is instructing execution of printing process or the light-receiving signal from the light-receiving element 82 and by executing the program stored in the memory 19 with the CPU.

The image forming unit 11 controls the operation of the laser printer 1 by controlling the sheet supply unit 3 (the sheet supply mechanism 32), the exposing unit 4 (the right source, the polygon mirror), the process unit 5 (the photosensitive drum 51, the transfer roller 53, the developing roller 54, the supply roller 55, the agitator 70), the fixing unit 6 (the heat roller 61, the pressure roller 62), and the discharge roller 23.

The image forming unit 11 has a normal printing mode (first image forming mode), a low-speed printing mode (second image forming mode), and a detection mode.

The image forming unit 11 in the normal printing mode executes a normal printing process for forming images on a paper sheet S that is normally used in the laser printer 1, such as a plain paper sheet, while controlling the photosensitive drum 51, the agitator 70, and the like to rotate at a predetermined rotation speed V1.

The image forming unit 11 in the low-speed printing mode executes a low-speed printing process for forming images on a paper sheet S having thick thickness, such as an envelop, a postcard, or a thick plain paper sheet, while controlling the photosensitive drum 51, the agitator 70, and the like to rotate at a predetermined rotation speed V2, which is slower than the rotation speed V1. By forming images at a lower speed (by lowering the sheet convey speed) when the paper sheet S is thick, then toner images transferred onto the paper sheet S can be reliably thermally fixed onto the paper sheet S.

The image forming unit 11 enters the detection mode when a detection process to be described later is instructed (executed), and the image forming unit 11 in the detection mode controls the agitator 70 to rotate at the rotation speed V1.

The calculating unit 12 calculates a value regarding amount of toner T remaining in the developing cartridge 5B based on the light-receiving signal received from the light-receiving element 82. In this embodiment, the calculating unit 12 calculates a time ratio TR, which is a ratio of time duration, in which the light-receiving element 82 receives the detection light (i.e., the calculating unit 12 receives the light-receiving signal) within a predetermined time duration, to the predetermined time duration.

Note that the calculating unit 12 of this embodiment does not calculate a numerical number as an amount of the toner T. However, if the time ratio TR is smaller, this means that more amount of the detection light is blocked by the toner T in the developing cartridge 5B, so it can be estimated that the amount of toner T in the developing cartridge 5B is larger. If the time ratio TR is larger, on this other hand, this means that less amount of the detection light passes through the developer cartridge 5B and reaches the light-receiving element 82 without being blocked by the toner T, so it can be estimated that the amount of toner T in the developing cartridge 5B is smaller.

The calculating unit 12 outputs information indicating the calculated time ratio TR to the determining unit 13.

The determining unit 13 determines the replacement time of the developing cartridge 5B (determines whether or not the developing cartridge 5B should be replaced) based on the time ratio TR received from the calculating unit 12. More specifically, the determining unit 13 determines whether or not the time ratio TR has exceeded a predetermined determination threshold value Th1 when the image forming unit 11 is either in the normal printing mode or in the detection mode (i.e., while the agitator 70 is rotating at the rotation speed V1). If the time ratio TR has exceeded the determination threshold value Th1, then this means that the remaining amount of toner T in the developing cartridge 5B is lower than a first threshold amount, and the developing cartridge 5B determines that it is the replacement time of the developing cartridge 5B (i.e., that the developing cartridge 5B should be replaced).

If it is determined that the developing cartridge 5B should be replaced, then the determining unit 13 outputs information regarding this determination results to the notifying unit 9, instructing the notifying unit 9 to notify a user that the developing cartridge 5B should be replaced.

The determination threshold value Th1 is a threshold value that is used for determining, based on the time ratio TR calculated by the calculating unit 12, whether or not the amount of toner T has become lower than the first threshold amount. When the time ratio TR is greater than the determination threshold value Th1, then this means that only small amount of toner T that can be used for forming images remains in the developing cartridge 5B. The determination threshold value Th1 can be arbitrarily set in accordance with the maximum amount of toner T that the developing cartridge 5B can accommodate, specifications of the developing cartridge 5B (printable sheet number), and the like.

The time ratio TR may exceed the determination threshold value Th1 when the image forming unit 11 is in the low-speed printing mode. Thus, in this embodiment, slightly greater amount of toner T than is necessary is accommodated in the developing cartridge 5B such that degradation of image quality due to lack of toner does not occur at least until a detection process to be described later is executed.

The determining unit 13 also determines whether or not the time ratio TR has exceeded a predetermined tentative determination threshold value Th2 when the low-speed printing process is being executed (i.e., when the agitator 70 is rotating at the rotation speed V2). If it is determined that the time ratio TR has exceeded the tentative determination threshold value Th2, then the determining unit 13 outputs information regarding this determination results to the detection process executing unit 15.

The tentative determination threshold value Th2 is a threshold value that is used for determining, based on the time ratio TR calculated by the calculating unit 12, whether or not the amount of toner T remaining in the developing cartridge 5B has become lower than a second threshold amount that is greater than the first threshold amount when the image forming unit 11 is in the low-speed printing mode. When the time ratio TR becomes greater than the tentative determination threshold value Th2, then it can be estimated that it is close to the replacement time of the developing cartridge 5B (i.e., the replacement time of the developing cartridge 5B is tentatively determined).

In this embodiment, the tentative determination threshold value Th2 may be the same as the determination threshold value Th1. When determination is made based on the tentative determination threshold value Th2, the agitator 70 is rotating at the rotation speed V2 that is slower than the rotation speed V1, so the rotation of the agitator 70 stirs up less amount of toner T within the developing cartridge 5B. This makes easier for the detection light to pass through the developing cartridge 5B. Therefore, even if the tentative determination threshold value Th2 is equal to the determination threshold value Th1, an amount of toner T remaining in the developing cartridge 5B at the time of when it is determined that the time ratio TR has exceeded the tentative determination threshold value Th2 is greater than an amount of toner T at the time of when it is determined that the time ratio TR has exceeded the determination threshold value Th1. In other words, even if the tentative determination threshold value Th2 is equal to the determination threshold value Th1, the second threshold amount is greater than the first threshold amount.

In this embodiment, the determination whether or not the developing cartridge 5B should be replaced (whether the time ratio TR has exceeded the determination threshold value Th1) is regularly made by the determining unit 13 at appropriate timing, except at least when the image forming unit 11 is in the low-speed printing mode. More specifically, this determination by the determining unit 13 based on the determination threshold value Th1 is regularly made at appropriate timing when the agitator 70 rotates at the rotation speed V1. The agitator 70 rotates at the rotation speed V1 in the normal printing mode, the detection mode, and a warming-up mode which is executed before and after each printing mode and after the power to the laser printer 1 is turned ON.

The image forming amount counting unit 14 counts a value regarding image forming amount when the image forming unit 11 is in the low-speed printing mode. In this embodiment, the value regarding image forming amount is a dot number printed on the paper sheet(s) S. More specifically, the value regarding image forming amount is a dot number obtained based on information, which is included in image data received from the PC or the like and which is for controlling the light source of the exposing unit 4 to emit and not emit the laser light. The image forming amount counting unit 14 outputs information regarding the counted dot number (count value ND) to the detection process executing unit 15.

The detection process executing unit 15 determines whether or not the count value ND counted by the image forming amount counting unit 14 is greater than a predetermined count value ThD. If the detection process executing unit 15 has determined that the count value ND is greater than the predetermined count value ThD and also has received the information from the determining unit 13 indicating that the time ratio TR is greater than tentative determination threshold value Th2 while the image forming unit 11 is in the low-speed printing mode, then the detection process executing unit 15 executes a detection process.

In the detection process, the detection process instructing unit 15 outputs a command to the image forming unit 11, instructing the image forming unit 11 to enter the detection mode.

Upon receiving the command from the detection process executing unit 15, the image forming unit 11 halts the low-speed printing process (i.e., stops sheet conveying operation of the sheet supply unit 3, light-emitting operation of the exposing unit 4 (the light source), and the like) and enters the detection mode in which the image forming unit 11 drives the process unit 5 in the same manner as in the normal printing mode. That is, the rotation speed of the agitator 70 is changed from the rotation speed V2 to the rotation speed V1. The image forming unit 11 remains in the detection mode for a predetermined time duration. In the detection process, the detection process executing unit 15 also controls the determining unit 13 to determine whether or not it is the replacement time of the developing cartridge 5B while the image forming unit 11 in the detection mode. That is, the determining unit 13 determines whether or not it is the replacement time of the developing cartridge 5B based on the time ratio TR calculated by the calculating unit 12 based on the light-receiving signal output from the light-receiving element 82 when the agitator 70 is rotating at the rotation speed V1.

The predetermined count value ThD is a predetermined threshold value (predetermined threshold dot number). The predetermined count value ThD may be set to a dot number required to print on 10 or 20 paper sheets S, assuming that JIS X6931 standard test page is printed on each paper sheet S. Thus, in this embodiment, the detection process is executed once each time a plurality of paper sheets S (10 or 20 paper sheets S, for example) has been sequentially printed on in the low-speed printing process.

By executing the detection process under the condition that the count value ND has exceeded the predetermined count value ThD, i.e., that the low-speed printing process is continuously executed, the execution number of the detection process can be lowered compared of the case in which the detection process is executed each time a single paper sheet S is printed on in the low-speed printing process, for example.

Also, by executing the detection process under the condition that the time ratio TR has exceeded the tentative determination threshold value Th2, i.e., that it is close to the replacement time of the developing cartridge 5B, the execution number of the detection process can be lowered compared of the case in which the detection process is executed at a timing where there is no possibility that the replacement time of the developing cartridge 5B is determined (for example, at a timing immediately after the developing cartridge 5B has been replaced).

The toner T in the developing cartridge 5B is inevitably decreased in its chargeability as being repeatedly agitated by the agitator 70 and rubbed between the developing roller 54 and the supply roller 55 or the thickness-regulation blade 56. Thus, unnecessary rotation of the agitator 70 and the developing roller 54 in the detection process (process other than the printing processes) accelerates lowering of the chargeability. Also, once the detection process is started, a user needs to wait for an end of the detection process. Further, execution of the detection process delays completion of the low-speed printing process of a single job.

However, according to this embodiment, the execution number of the detection process can be lowered by using the above-described two conditions. This suppresses lowering of the chargeability of toner T, reduces the number of times that the user waits for an end of the detection process, and also shortens the time of the image forming operation.

The rest unit 16 resets the count value ND of the image forming amount counting unit 14 when the agitator 70 rotates at the rotation speed V1. That is, the rest unit 16 resets the count value ND when the normal printing process or the detection process is executed.

The notifying unit 9 notifies a message to a user of the laser printer 1. In this embodiment, when the replacement time of the developing cartridge 5B is determined by the determining unit 13, the notifying unit 9 notifies the user of a message indicating this determination result. The notifying unit 9 may be a liquid crystal display for notifying the message with letters and graphics, a speaker for notifying the message with sound, a lamp for notifying the message with blink of light, or a combination of any of the liquid crystal display, the speaker, and the lamp.

Next, a determination process executed by the control unit 10 for determining the replacement time of the developing cartridge 5B will be described with reference to FIGS. 5 and 6. This determination process is started when image data (job) instructing image formation (printing) is received from the PC or the like.

Figure 6:
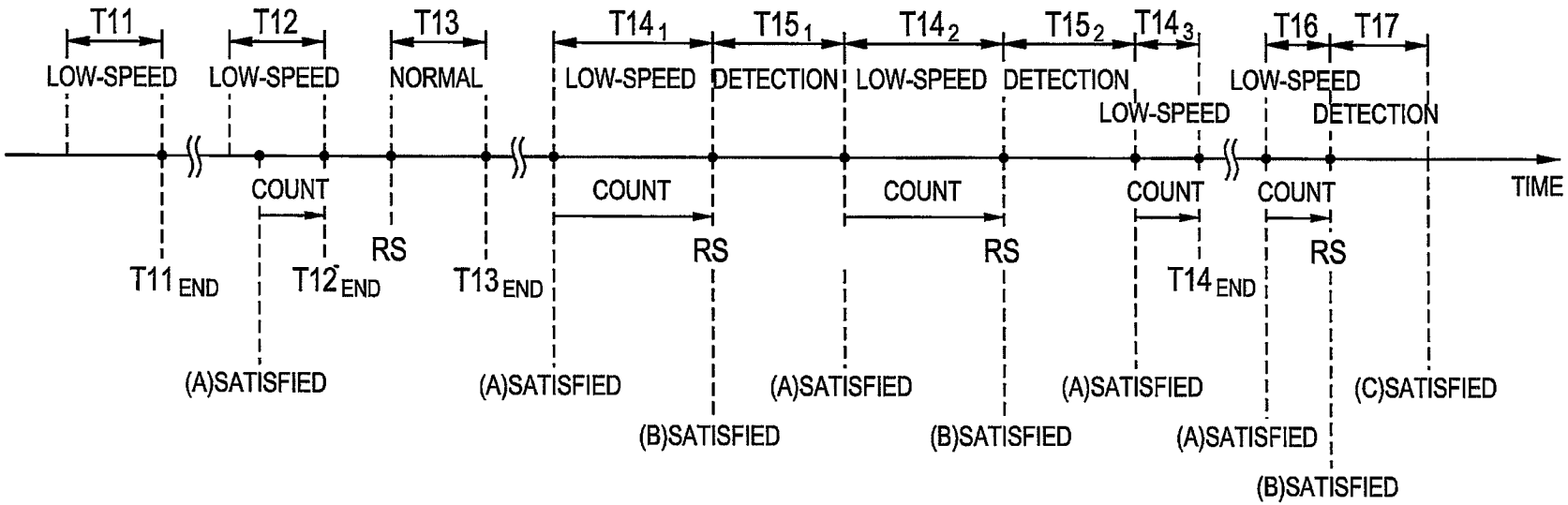
FIG. 6 is a time chart of the determination process according to the first embodiment of the invention.

Note that in FIG. 6 "(A) SATISFIED" denotes that the time ratio TR is greater than the tentative determination threshold value Th2, "(B) SATISFIED" denotes that the count value ND is greater than the predetermined count value ThD, and "(C) SATISFIED" denotes that the time ratio TR is greater than the determination threshold value Th1.

Figure 5:
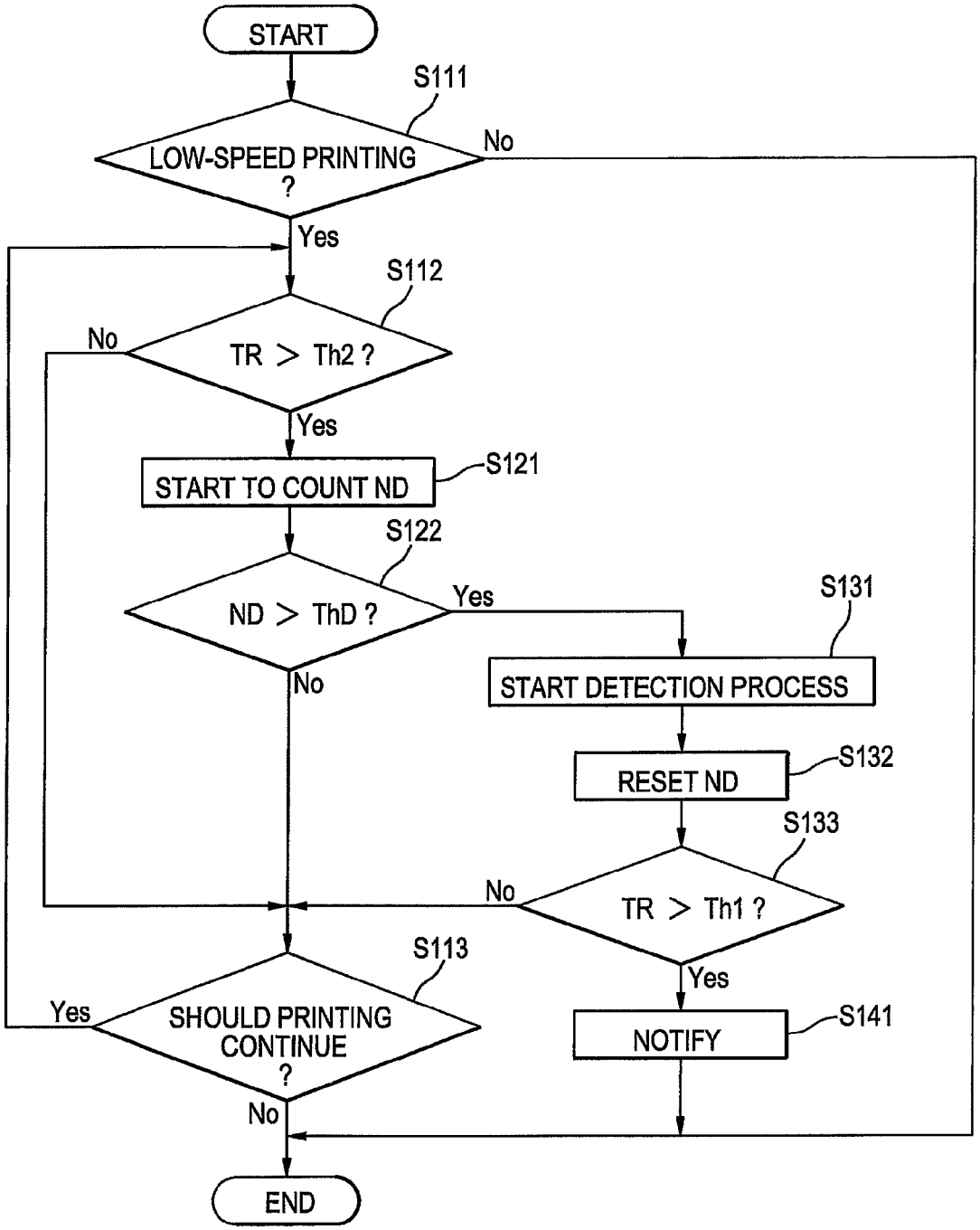
FIG. 5 is a flowchart representing a determination process according to the first embodiment of the invention.

First, in S111 of FIG. 5, the control unit 10 determines whether or not the received image data is for executing the low-speed printing process. If so (S111:Yes), then the control unit 10 starts the low-speed printing process, and then in S112, the control unit 10 determines whether or not the time ratio TR is greater than the tentative determination threshold value Th2.

After a new developing cartridge 5B has been installed, the time ratio TR does not exceed the tentative determination threshold value Th2 until the amount of toner T within the developing cartridge 5B decreases to some extent. In the example shown in FIG. 6, the time ratio TR does not exceed the tentative determination threshold value Th2 while a low-speed printing process T11 is being executed (S112:No). In this case, the control unit 10 proceeds to S113 and determines whether or not the printing should continue. If so (S113:Yes), then the control unit 10 returns to S112. On the other hand, if not (S113:No), then the control unit 10 ends the determination process ($T11_{END}$).

However, when the amount of toner T within the developing cartridge 5B decreases to some extent, the time ratio TR exceeds the tentative determination threshold value Th2 (S112:Yes). In the example shown in FIG. 6, the time ratio TR exceeds the tentative determination threshold value Th2 when a low-speed printing process T12 is being executed ((A) SATISFIED). Then, the control unit 10 starts to count the dot number (ND) in S121, and determines whether or not the count value ND is greater than the predetermined count value ThD in S122.

In FIG. 6, there is only a small number of paper sheets S (dot number) yet to be printed at the time of when the time ratio TR has exceeded the tentative determination threshold value Th2 ((A) SATISFIED) while the low-speed printing process T12 is being executed. In this case, without the count value ND exceeding the predetermined count value ThD (S122:No), the determination process is ended (S113:No, $T12_{END}$).

On the other hand, if the received image data is for executing the normal printing process (S111:No), then the control unit 10 starts the normal printing process (a normal printing process T13, for example). In this case, the agitator 70 is rotated at the rotation speed V1, and thus the control unit 10 resets the count value ND (RS in FIG. 6). Note that if the control unit 10 determines the replacement time of the developing cartridge 5B when the normal printing process is being executed, then the control unit 10 controls the notifying unit 9 to notify a user of a message that it is the replacement time of the developing cartridge 5B.

A low-speed printing process $T14_1$ is started when image data (job) for executing the low-speed printing process to print images continuously on a relatively large number of paper sheets S is received after the amount of toner T in the developing cartridge 5B has decreased to some extent, and the count value ND exceeds the predetermined count value ThD (S122:Yes, (B) SATISFIED) while the low-speed printing process $T14_1$ is being executed. In this case, the control unit 10 halts the low-speed printing process and then starts a detection process $T15_1$ in S131. In this detection process, the agitator 70 rotates at the rotation speed V1, and thus the control unit 10 resets the count value ND in S132 (RS).

If the control unit 10 determines that the time ratio TR is not greater than the determination threshold value Th1 in this detection process $T15_1$ (S133:No), and if the control unit 10 determines that the printing should continue (S113:Yes), then the control unit 10 resumes the low-speed printing process (a low-speed printing process $T14_2$).

A detection process $T15_2$ is started in the same manner. If the control unit 10 does not determine that the time ratio TR is greater than the determination threshold value Th1 in this detection process $T15_2$ (S133:No), and if the control unit 10 determines that the printing should continue (S113:Yes), then the control unit 10 resumes the low-speed printing process (a low-speed printing process $T14_3$). There is only small number of paper sheets S yet to be printed when the low-speed printing process $T14_3$ is started. Thus, in this case, without the count value ND exceeding the predetermined count value ThD (S122:No), the determination process is ended (S113: No, $T14_{END}$).

When image data (job) for executing the low-speed printing process for printing images continuously on a relatively large number of paper sheets S is received after the amount of toner T in the developing cartridge 5B has further decreased, then the control unit 10 determines that the time ratio TR is greater than the determination threshold value Th1 (S133: Yes, (C) SATISFIED) in a detection process T17 executed after a low-speed printing process T16. In this case, the control unit 10 determines the replacement time of the developing cartridge 5B, and controls the notifying unit 9 to notify a user of a message indicating that the developing cartridge 5B should be replaced in S141.

As described above, according to the first embodiment, when the count value ND exceeds the predetermined count value ThD when the low-speed printing process is being executed, then the rotation speed of the agitator 70 is changed from the rotation speed V2 to the rotation speed V1, and the determining unit 13 of the control unit 10 makes determination while the agitator 70 is rotating at the rotation speed V1. Thus, determination as to whether or not the developing cartridge 5B should be replaced is always made while the agitator 70 is rotating at the rotation speed V1.

Thus, although the laser printer 1 has a plurality of printing modes, determination as to whether or not the developing cartridge 5B should be replaced is always made under the same condition. Therefore, it is unnecessary to determine the replacement time of the developing cartridge 5B based on different conditions for each printing mode, and also the amount of toner T remaining in the developing cartridge 5B at the time of when the replacement time of the developing cartridge 5B is determined does not differ depending on the printing mode. This makes it possible to avoid waste of toner T remaining in the developing cartridge 5B.

Because the detection process is executed only if the count value ND exceeds the predetermined count value ThD and if the time ratio TR exceeds the tentative determination threshold value Th2, it is possible to reduce the execution time of the detection process. This suppress lowering of the chargeability of the toner T, reduces the number of time the user waits for an end of the detection process, and shortens the overall image forming process.

Because the control unit 10 has the rest unit 16 that resets the count value ND of the image forming amount counting unit 14 when the agitator 70 rotates at the rotation speed V1, the image forming amount counting unit 14 starts to count the count value ND from zero when the low-speed printing process is resumed after the detection process. Thus, it is possible to reduce the execution time of the detection process. This suppresses lowering of the chargeability of the toner T, reduces the number of time the user waits for an end of the detection process, and shortens the overall image forming process.

<Second Embodiment>

Next, a second embodiment of the invention will be described.

In the above-described first embodiment, the image forming amount counting unit 14 starts to count the dot number (S121) after the time ratio TR calculated by the calculating unit 12 has exceeded the tentative determination threshold value Th2. However, in this second embodiment, the image forming amount counting unit 14 starts to count the dot number at the start of the low-speed printing process, and the detection process is executed if the time ratio TR exceeds the tentative determination threshold value Th2 after the count value ND has exceeded the predetermined count value ThD.

As the control unit 10 of the first embodiment shown in FIG. 4, the control unit 10 of this embodiment also has the image forming unit 11, the calculating unit 12, the determining unit 13, the image forming amount counting unit 14, the detection process executing unit 15, and the rest unit 16.

Note that the rest unit 16 of this embodiment resets the count value ND if the time ratio TR is not greater than the tentative determination threshold value Th2 at the time of when the count value ND has exceeded the predetermined count value ThD. The rest unit 16 of this embodiment also resets the count value ND when the rotation speed of the agitator 70 is changed from the rotation speed V2 to the rotation speed V1, i.e., when the detection process is executed.

Next, a determination process according to the second embodiment will be described with reference to FIGS. 7 and 8. This determination process is started when image data (job) instructing image formation (printing) is received from the PC or the like.

Figure 7:
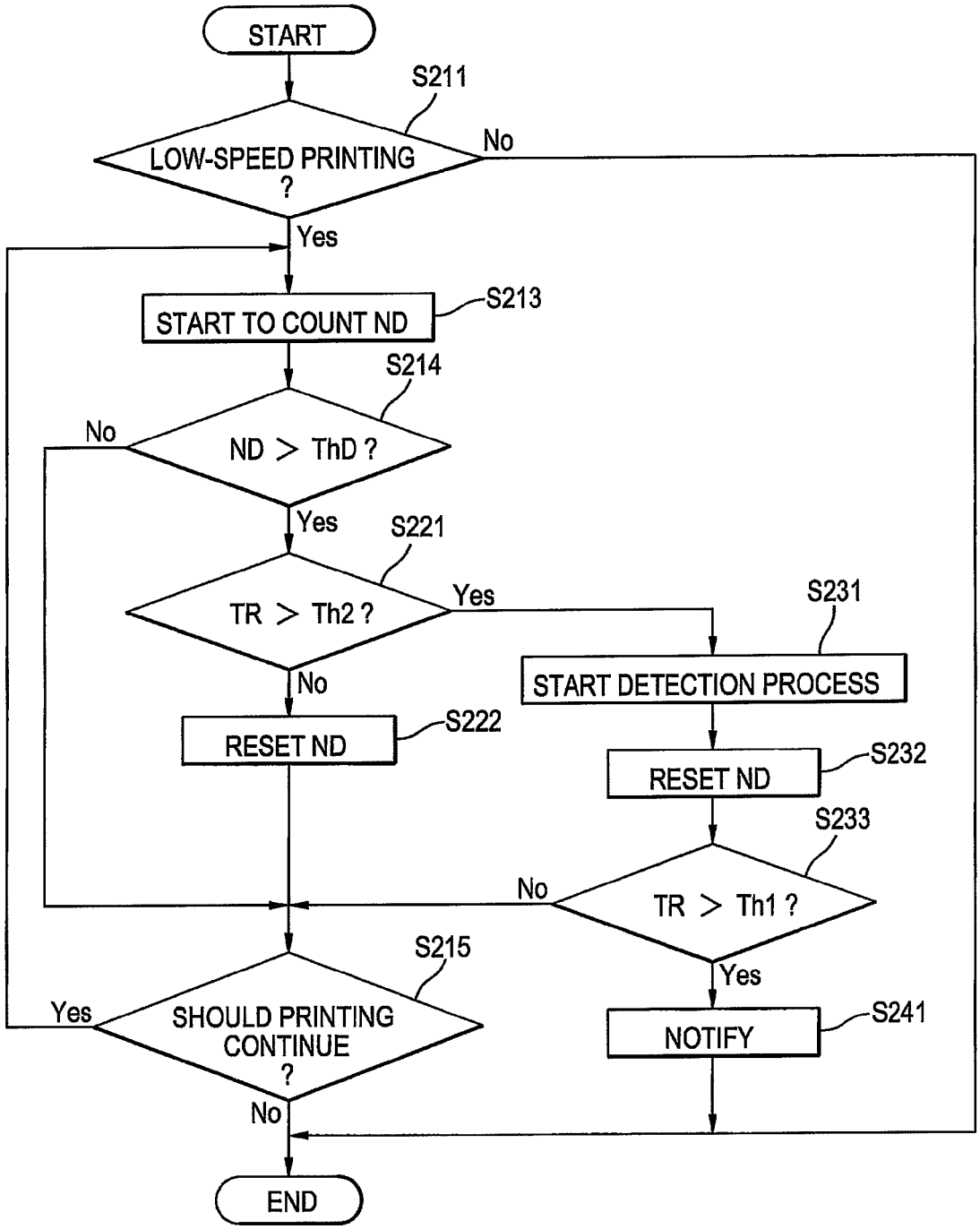
FIG. 7 is a flowchart representing a determination process according to a second embodiment of the invention.

First, in S211 of FIG. 7, the control unit 10 determines whether or not the received image data is for executing the low-speed printing process. If so (S211:Yes), then the control unit 10 starts the low-speed printing process, and then starts to count the dot number (ND) in S213. Next, the control unit 10 determines in S214 whether or not the count value ND has exceeded the predetermined count value ThD.

Figure 8:
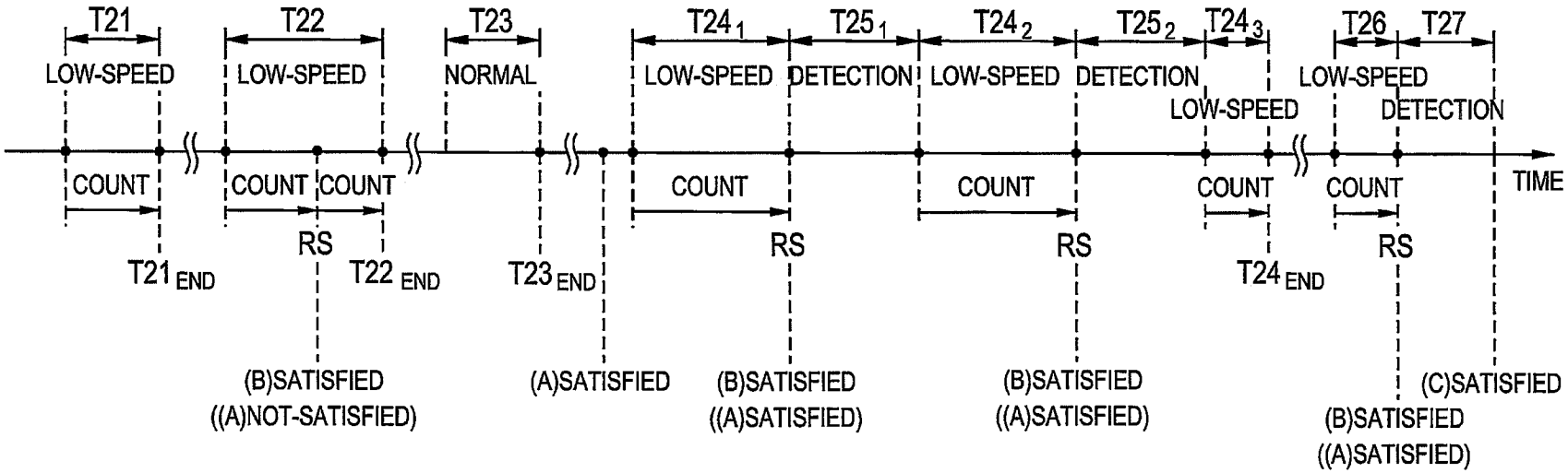
FIG. 8 is a time chart of the determination process according to the second embodiment of the invention.

A low-speed printing process T21 shown in FIG. 8 is started when image data for executing the low-speed printing process for forming images on a relatively small number of paper sheets S is received. In this case, without the count value ND exceeding the predetermined count value ThD (S214:No), the determination process is ended (S215:No, T21$_{END}$).

A low-speed printing process T22 shown in FIG. 8 is started, on the other hand, when image data for executing the low-speed printing process for forming images on a relatively large number of paper sheets S is received, and the count value ND exceeds the predetermined count value ThD (S214: Yes, (B) SATISFIED) while the low-speed printing process T22 is being executed. In this case, the control unit 10 determines in S221 whether or not the time ratio TR has exceeded the tentative determination threshold value Th2.

After a new developing cartridge 5B has been replaced, the time ratio TR does not exceed the tentative determination threshold value Th2 unless the amount of toner T within the developing cartridge 5B has decreased to some extent. In the example shown in FIG. 8, the time ratio TR does not exceed the tentative determination threshold value Th2 (S221:No) while the low-speed printing process T22 is being executed ((A) NOT-SATISFIED). Thus, the control unit 10 resets the count value ND in S222 (RS), and continues the low-speed printing process T22 (S215:Yes). At this time, there is only a relatively small number of paper sheets S yet to be printed on (small number of dots to be printed), so the determination process is ended (S215:No, T22$_{END}$) without the count value ND exceeding the predetermined count value ThD (S214: No).

If the received image data is for executing the normal printing process (S211:No), then the control unit 10 executes the normal printing process (a normal printing process T23).

A low-speed printing process T24$_1$ is started when image data (job) for executing the low-speed printing process for forming images continuously on a relatively large number of paper sheets S is received after the amount of toner T in the developing cartridge 5B has further decreased (after the time ratio TR becomes greater than the tentative determination threshold value Th2), and the count value ND exceeds the predetermined count value ThD (S214:Yes, (B) SATISFIED) while the low-speed printing process T24$_1$ is being executed. In this case, the time ratio TR is determined to be greater than the tentative determination threshold value Th2 (S221:Yes), so the control unit 10 halts the low-speed printing process T24$_1$ and starts a detection process T25$_1$ in S231. Because the rotation speed of the agitator 70 is changed from the rotation speed V2 to the rotation speed V1 at this time, the control unit 10 resets the count value ND in S232 (RS).

Next, in S233, the control unit 10 determines whether or not the time ratio TR is greater than the determination threshold value Th1 in this detection process T25$_1$. If a negative determination is made in S233 (S233:No), and if the printing should be continued (S215:Yes), then the control unit 10 resumes the low-speed printing process (a low-speed printing process T24$_2$), and a detection process T25$_2$ is executed thereafter. Because there is only a small number of paper sheets S yet to be printed on when a low-speed printing process T24$_3$ is started, the determination process is ended (S215:No, T24$_{END}$) without the count value ND exceeding the predetermined count value ThD (S214:No).

A low-speed printing process T26 is started when image data (job) for executing the low-speed printing process for forming images continuously on a relatively large number of paper sheets S is received after the amount of toner T in the developing cartridge 5B has further decreased, and the time ratio TR is determined to be greater than the determination threshold value Th1 in a detection process T27 executed after the low-speed printing process T26 (S233:Yes, (C) SATISFIED). In this case, the control unit 10 determines the replacement time of the developing cartridge 5B, and controls the notifying unit 9 to notify a user of a message indicating that the developing cartridge 5B should be replaced in S241.

With the configuration of this second embodiment also, the same effects as the first embodiment can be achieved. Note that the rest unit 16 of the present embodiment may be the same as the rest unit 16 of the first embodiment.

<Third Embodiment>

Next, a third embodiment of the invention will be described.

In the above-described second embodiment, the image forming amount counting unit 14 starts to count the dot number at the start of the low-speed printing process. However, in this embodiment, the image forming amount counting unit 14 starts to count the dot number after printing has been executed a predetermined amount after replacement of the developing cartridge 5B.

Figure 9:
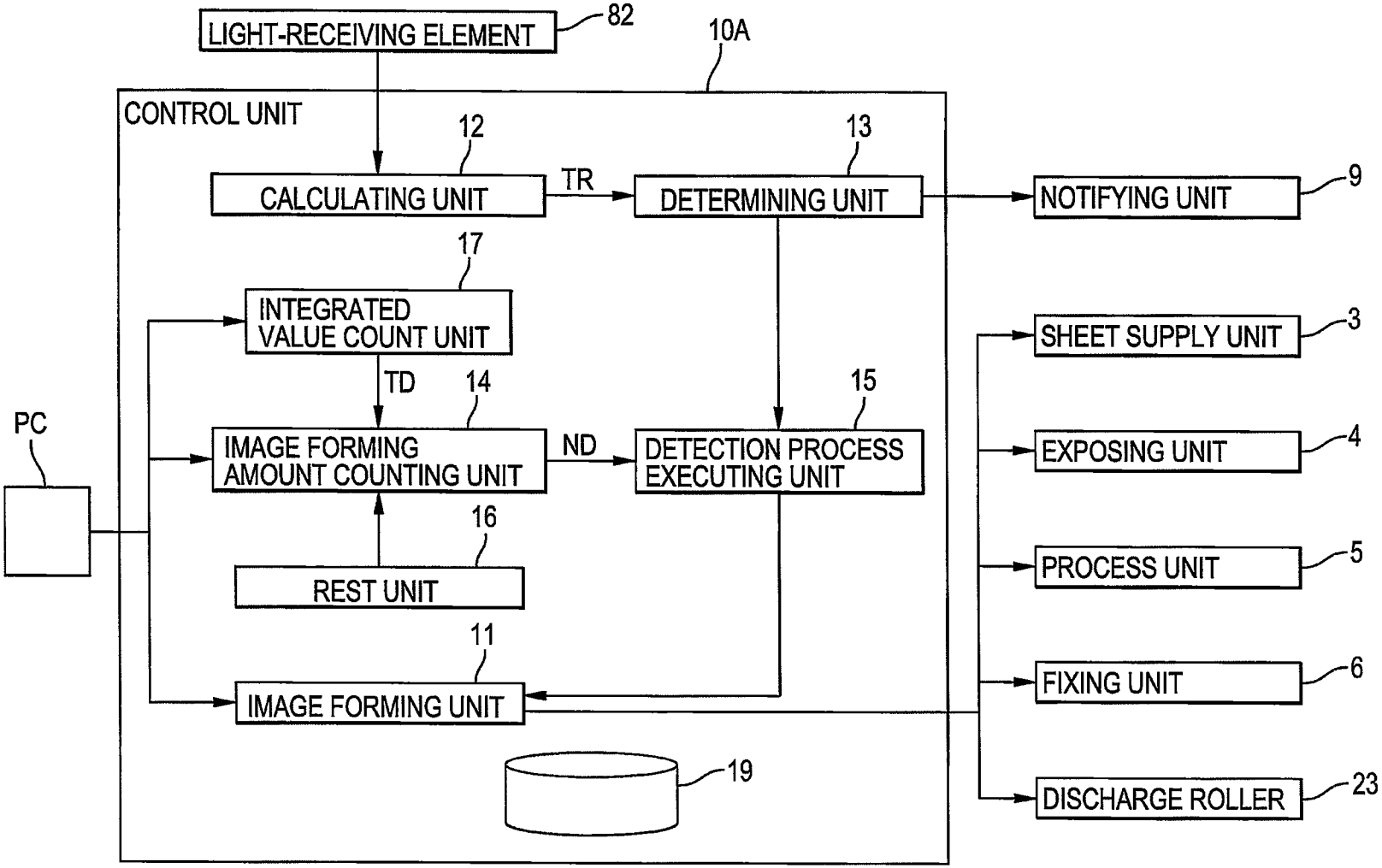
FIG. 9 is a block diagram of a laser printer as an image forming process according to a third embodiment of the invention.

As shown in FIG. 9, a control unit 10A of this embodiment includes an integrated value count unit 17 in addition to the calculating unit 12, the determining unit 13, the image forming amount counting unit 14, the detection process executing unit 15, and the rest unit 16. The rest unit 16 of this embodiment is the same as that of the second embodiment.

The integrated value count unit 17 counts a value indicating image forming amount (i.e., an integrated value of dot number printed on the paper sheets S) since replacement of the developing cartridge 5B. The integrated value count unit 17 outputs information regarding the counted integrated value (count value TD) to the image forming amount counting unit 14.

Note that "since replacement of the developing cartridge 5B" means "since the time of when a new (unused) developing cartridge 5B has been installed on the main casing 2." Also, the integrated value counted by the integrated value count unit 17 is reset when the developing cartridge 5B is replaced.

In this embodiment, the image forming amount counting unit 14 starts to count the dot number printed on the paper sheets S (value regarding image forming amount) after the count value TD has exceeded a predetermined integrated value ThC.

Note that the predetermined integrated value ThC is a threshold value predetermined in accordance with specification of the developing cartridge 5B (printable sheet number) and the like. Assuming that a dot number required to print JIS X6931 standard test page on a single paper sheet S is set as a dot number equivalent to a single paper sheet S, the predetermined integrated value ThC may be set to a dot number equivalent to 2,500 paper sheets S if the printable sheet number of the developing cartridge 5B is 3,000, and may be set to a dot number equivalent to 5,500 paper sheets S if the printable sheet number of the developing cartridge 5B is 6,000, for example. Accordingly, in this embodiment, the image forming amount counting unit 14 starts to count the dot number only after a predetermined amount of image forming process (printing on 2,500 or 5,500 sheets) has been performed.

Figure 10:
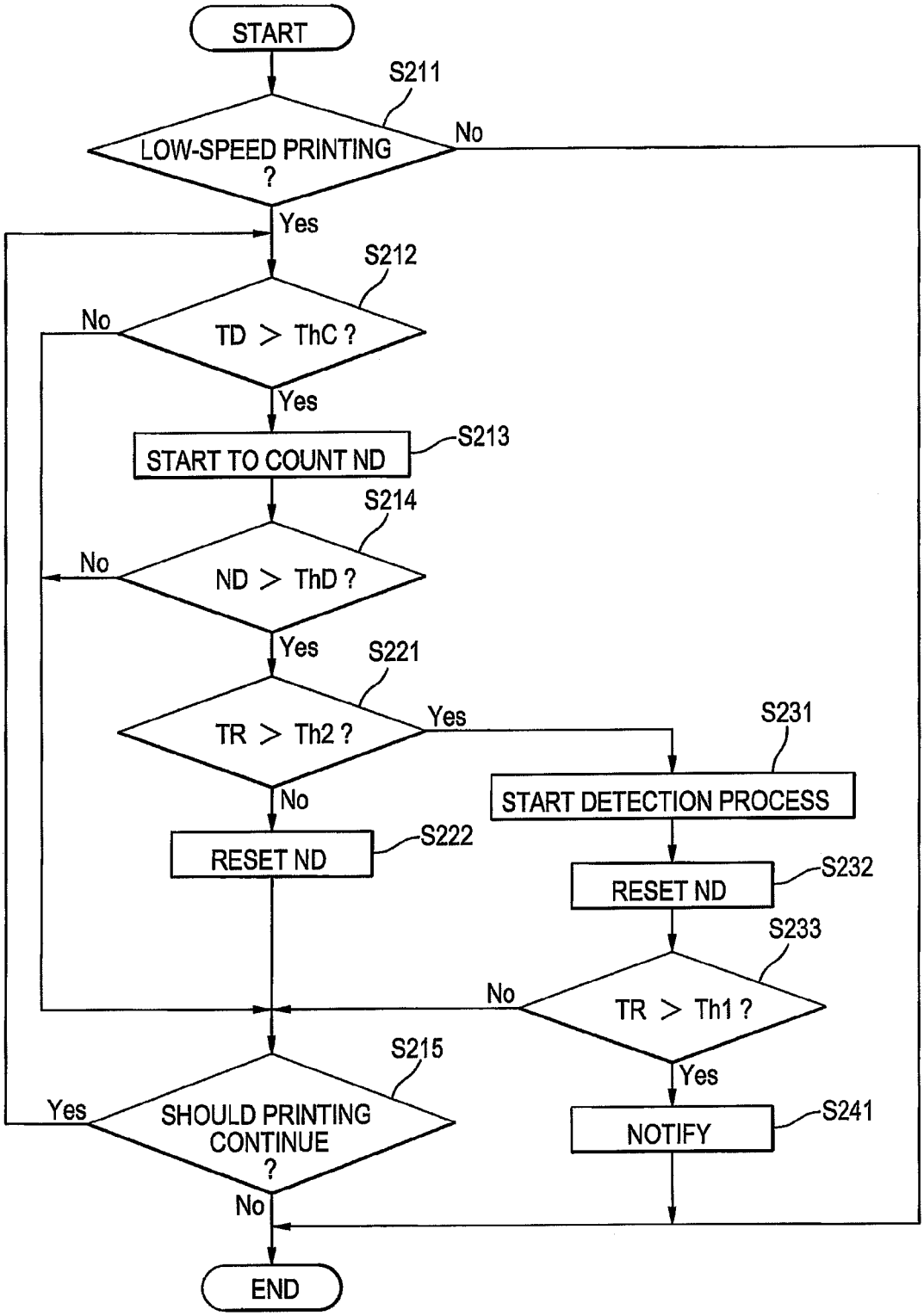
FIG. 10 is a flowchart representing a determination process according to the third embodiment of the invention.

Next, a determination process according to the third embodiment will be described with reference to FIG. 10. This determination process is the same as that of the determination process according to the second embodiment shown in FIG. 7, but differs in that a process of S212 is added between S211 and S213.

That is, after a positive determination is made in S211 (S211:Yes), the low-speed printing process is started, and the control unit 10A determines in S212 whether or not the count value TD counted by the integrated value count unit 17 has exceeded the predetermined integrated value ThC.

Unless the printing process is performed a predetermined amount (until printed dot number reaches a predetermined number) after replacement of the developing cartridge 5B, the count value TD does not exceed the predetermined integrated value ThC (S212:No). In this case, the control unit 10A repeats S212 and S215.

On the other hand, when the printing process has been performed the predetermined amount, then the count value TD exceeds the predetermined integrated value ThC (S212: Yes). In this case, the control unit 10 starts to count the dot number in S213, and determines whether or not the count value ND has exceeded the predetermined count value ThD in S214.

When the low-speed printing process is being executed based on image data (job) for printing images continuously on a relatively large number of paper sheets S, the count value ND exceeds the predetermined count value ThD (S214:Yes), so the control unit 10 determines in S221 whether or not the time ratio TR has exceeded the tentative determination threshold value Th2. If the count value TD exceeds the predetermined integrated value ThC after printing process has been performed some amount, this means that the amount of toner T in the developing cartridge 5B has decreased to some extent. Thus, there is a greater possibility that the time ratio TR exceeds the tentative determination threshold value Th2.

When the time ratio TR exceeds the tentative determination threshold value Th2 (S221:Yes), then the control unit 10A halts the low-speed printing process, starts the detection process in S231, and resets the count value ND in S232. If it is determined in S233 that the time ratio TR is not greater than the determination threshold value Th1 in the detection process (S233:No), then the control unit 10A proceeds to S215.

When the amount of toner T in the developing cartridge 5B has further decreased, it may be determined in S233 that the time ratio TR is greater than the determination threshold value Th1 in the detection process (S233:Yes). In this case, the control unit 10 determines that the developing cartridge 5B should be replaced, and controls the notifying unit 9 to notify a user of a message that the developing cartridge 5B should be replaced in S241.

With the configuration of this embodiment, those effects of the first and second embodiments can be achieved.

Also, in this third embodiment, because the image forming amount counting unit 14 starts to count the dot number only after the count value TD counted by the integrated value count unit 17 has exceeded the predetermined integrated value ThC, the detection process is not executed until the image forming process has been performed a predetermined amount after replacement of the developing cartridge 5B. In other words, according to the present embodiment, the execution number of the detection process can be reduced. Thus, it is possible to suppress lowering of the chargeability of the toner T, to reduce the number of time the user waits for an end of the detection process, and to shorten the overall image forming process.

While the invention has been described in detail with reference to the embodiments thereof, it would be apparent to those skilled in the art that various changes and modifications may be made therein without departing from the spirit of the invention.

For example, in the above-described embodiments, the image forming amount counting unit 14 counts the dot number printed on the paper sheets S as a value regarding image forming amount. However, this is not a limitation of the invention. For example, the value regarding the image forming amount may be a number of sheets printed with images (printed sheet number). The printed sheet number may be counted based on detection results of a sheet sensor, which is a sensor usually provided in an image forming device for detecting passage of paper sheets S, or based on information included in image data sent from the PC or the like, which specifies sheet number to be printed on.

The value regarding the image forming amount may be a rotation number of the agitator 70. The rotation number may be either directly counted or obtained through calculation. The rotation of the agitator 70 is not limited to the rotation of the agitator 70 itself, but may be a rotation number of a gear that transmits rotary driving power to the agitator 70, a rotation number of a member that rotates in association with rotation of the agitator 70 (such as the photosensitive drum 51 or the developing roller 54), or a rotation number of a gear that transmits the rotary driving power to the member that rotates in association with rotation of the agitator 70.

In the above described embodiments, the detection process is executed if the count value ND exceeds the predetermined count value ThD in the low-speed printing mode and if the time ratio TR exceeds the tentative determination threshold value Th2. However, this is not a limitation of the invention. For example, at least when the count value ND counted by the image forming amount counting unit 14 has exceeded the predetermined count value ThD in the low-speed printing mode, the rotation speed of the agitator 70 may be changed from the rotation speed V2 to the rotation speed V1, and the detection of the toner amount may be executed while the agitator 70 is rotating at the rotation speed V1.

In the above-described embodiments, the low-speed printing mode for forming images on a thicker paper sheet S than in the normal printing mode is described as an example of second image forming mode. However, the second image forming mode may alternatively be a mode for forming images with a higher resolution.

In the above-described embodiments, the calculating unit 12 is described as a unit for calculating the time ratio TR. However, the calculating unit 12 may be a unit for calculating the intensity of the detection light received at the light-receiving element 82. In this case, the calculating unit 12 and the determining unit 13 may be combined into a single unit.

Note that when the intensity of the detection light received at the light-receiving element 82 is weak (including when no detection light is received at the light-receiving element 82), this means that the detection light emitted into the developing cartridge 5B is blocked by the toner T. Thus, it is estimated that the amount of toner T in the developing cartridge 5B is large. When the intensity of the detection light received at the light-receiving element 82 is strong, on the other hand, this means that the detection light emitted into the developing cartridge 5B is received by the light-receiving element 82 without being blocked by the toner T. Thus, it is estimated that the amount of toner T in the developing cartridge 5B is small.

In the above-described embodiments, the calculating unit 12 does not calculate the amount of toner T in the developing cartridge 5B. However, the calculating unit 12 can be configured to calculate a numerical number as an amount (estimated amount) of toner T in the developing cartridge 5B.

In the above-described embodiments, the rest unit 16 is provided for resetting the count value ND counted by the image forming amount counting unit 14. However, an image forming device of the invention may be configured without the rest unit 16.

The agitator 70 may be provided with a wiper for cleaning the window 60 by wiping the toner T off the window 60. The agitator 70 may also be provided with a light shield for adjusting a receiving time of the detection light that passes through the developing cartridge 5B.

The developing cartridge 5B has been described as an example of a cartridge in the above embodiments. However, the cartridge of the invention may be a toner cartridge or a process cartridge integrally including the photosensitive unit 5A and the developing cartridge 5B undetachable from each other.

The laser printer 1 for forming monochrome images has been described as an example of an image forming device of the invention. However, the image forming device of the invention may be a printer capable of forming color images, a copier device, or a multifunction device.

In the above embodiments, the paper sheet S, such as a plain paper or a thick paper, has been described as an example of a recording sheet. However, the recording sheet may be OHP sheet, for example.

What is claimed is:

1. An image forming device comprising:

a main casing;

a cartridge detachably accommodated in the main casing and including an agitator that rotates to agitate developer accommodated in the cartridge;

a light-emitting element that emits a light into the cartridge;

a light-receiving element that receives the light that has passed through the cartridge;

a calculating unit that calculates a time ratio, which is a ratio of time duration, in which the light-receiving element receives the detection light within a predetermined duration, to the predetermined time duration;

a determining unit that determines whether the time ratio calculated by the calculating unit is greater than a first threshold value, wherein the determining unit determines that the cartridge should be replaced when the time ratio calculated by the calculating unit is determined to be greater than the first threshold value, the determining unit also determines whether the time ratio calculated by the calculating unit is greater than a second threshold value, the second threshold value being lower than the first threshold value;

an image forming unit having a first image forming mode for forming images on a recording sheet while rotating the agitator at a first rotation speed and a second image forming mode for forming images on a recording sheet while rotating the agitator at a second rotation speed that is lower than the first rotation speed;

a counting unit that counts a second value regarding image forming amount when the image forming unit is in the second image forming mode;

a detection process executing unit that determines whether the second value is greater than a predetermined count value while the image forming unit is in the second image forming mode, the detection process executing unit executing a detection process if the second value is determined to be greater than the predetermined count value while the image forming unit is in the second image forming mode; and a reset unit that resets the second value if the time ratio is determined not to be greater than the second threshold value at the time of when the second value is determined to be greater than the predetermined count value, wherein:

in the detection process, the detection process executing unit controls the image forming unit to change a rotation speed of the agitator from the second rotation speed to the first rotation speed, and controls the determining unit to determine whether the cartridge should be replaced while the agitator is rotating at the first rotation speed, and the detecting process executing unit executes the detection process if the time ratio is determined to be greater than the second threshold value while the image forming unit is in the second image forming mode.

2. The image forming device according to claim 1, wherein the second value is any one of a dot number printed on a recording sheet, a number of recording sheets printed with images, and a rotation number of the agitator.

3. The image forming device according to claim 1, further comprising an integrated value count unit that counts an integrated value of image forming amount since replacement of the cartridge, wherein the counting unit starts to count the second value after the integrated value counted by the integrated value count unit has exceeded a predetermined integrated value.

4. The image forming device according to claim 1, wherein the reset unit resets the second value if the agitator rotates at the first rotation speed and if the time ratio is determined not to be greater than the second threshold value at the time of when the second value is determined to be greater than the predetermined count value.

5. The image forming device according to claim 1, wherein the reset unit resets the second value if the rotation speed of the agitator is changed from the second rotation speed to the first rotation speed and if the time ratio is determined not to be greater than the second threshold value at the time of when the second value is determined to be greater than the predetermined count value.

6. The image forming device according to claim 1, wherein the image forming unit performs operations in the second image forming mode when forming images on a thicker recording sheet than in the first image forming mode.

7. The image forming device according to claim 1, wherein the determining unit determines that an amount of developer accommodated in the cartridge is less than a predetermined developer amount when the time ratio calculated by the calculating unit is greater than the first threshold value.

8. The image forming device according to claim 1, wherein:

the image forming unit also has a detection mode; and in the detection process, the detection process executing unit controls the image forming unit to enter the detection mode to change the rotation speed of the agitator from the second rotation speed to the first rotation speed.

9. An image forming device comprising:

a main casing;

a cartridge detachably accommodated in the main casing and including an agitator that rotates to agitate developer accommodated in the cartridge;

a light-emitting element that emits a light into the cartridge;

a light-receiving element that receives the light that has passed through the cartridge;

a calculating unit that calculates a time ratio, which is a ratio of time duration, in which the light-receiving element receives the detection light within a predetermined duration, to the predetermined time duration;

a determining unit that determines whether the time ratio calculated by the calculating unit is greater than a first threshold value, wherein the determining unit determines that the cartridge should be replaced when the time ratio calculated by the calculating unit is determined to be greater than the first threshold value;

an image forming unit having a first image forming mode for forming images on a recording sheet while rotating the agitator at a first rotation speed and a second image forming mode for forming images on a recording sheet while rotating the agitator at a second rotation speed that is lower than the first rotation speed;

a counting unit that counts a second value regarding image forming amount when the image forming unit is in the second image forming mode; and a detection process executing unit that determines whether the second value is greater than a predetermined count value while the image forming unit is in the second image forming mode, the detection process executing unit executing a detection process if the second value is determined to be greater than the predetermined count value while the image forming unit is in the second image forming mode; wherein:

in the detection process, the detection process executing unit controls the image forming unit to change a rotation speed of the agitator from the second rotation speed to the first rotation speed, and controls the determining unit to determine whether the cartridge should be replaced while the agitator is rotating at the first rotation speed, and the second value is any one of a dot number printed on a recording sheet, a number of recording sheets printed with images, and a rotation number of the agitator.

10. The image forming device according to claim 9, wherein:

the determining unit also determines whether the time ratio calculated by the calculating unit is greater than a second threshold value, the second threshold value being lower than the first threshold value; and the detecting process executing unit executes the detection process if the time ratio is determined to be greater than the second threshold value while the image forming unit is in the second image forming mode.

11. The image forming device according to claim 10, further comprising a reset unit that resets the second value if the time ratio is determined not to be greater than the second threshold value at the time of when the second value is determined to be greater than the predetermined count value.

12. The image forming device according to claim 9, further comprising an integrated value count unit that counts an integrated value of image forming amount since replacement of the cartridge, wherein the counting unit starts to count the second value after the integrated value counted by the integrated value count unit has exceeded a predetermined integrated value.

13. The image forming device according to claim 9, further comprising a reset unit that resets the second value when the agitator rotates at the first rotation speed.

14. The image forming device according to claim 9, further comprising a reset unit that resets the second value when the rotation speed of the agitator is changed from the second rotation speed to the first rotation speed.

15. The image forming device according to claim 9, wherein the image forming unit performs operations in the second image forming mode when forming images on a thicker recording sheet than in the first image forming mode.

16. The image forming device according to claim 9, wherein the determining unit determines that an amount of developer accommodated in the cartridge is less than a predetermined developer amount when the time ratio calculated by the calculating unit is greater than the first threshold value.

17. The image forming device according to claim 9, wherein:

the image forming unit also has a detection mode; and in the detection process, the detection process executing unit controls the image forming unit to enter the detection mode to change the rotation speed of the agitator from the second rotation speed to the first rotation speed.

18. An image forming device comprising:

a main casing;

a cartridge detachably accommodated in the main casing and including an agitator that rotates to agitate developer accommodated in the cartridge;

a light-emitting element that emits a light into the cartridge;

a light-receiving element that receives the light that has passed through the cartridge;

a calculating unit that calculates a time ratio, which is a ratio of time duration, in which the light-receiving element receives the detection light within a predetermined duration, to the predetermined time duration;

a determining unit that determines whether the time ratio calculated by the calculating unit is greater than a first threshold value, wherein the determining unit determines that the cartridge should be replaced when the time ratio calculated by the calculating unit is determined to be greater than the first threshold value;

an image forming unit having a first image forming mode for forming images on a recording sheet while rotating the agitator at a first rotation speed and a second image forming mode for forming images on a recording sheet while rotating the agitator at a second rotation speed that is lower than the first rotation speed;

a counting unit that counts a second value regarding image forming amount when the image forming unit is in the second image forming mode;

a detection process executing unit that determines whether the second value is greater than a predetermined count value while the image forming unit is in the second image forming mode, the detection process executing unit executing a detection process if the second value is determined to be greater than the predetermined count value while the image forming unit is in the second image forming mode; and a reset unit that resets the second value when the agitator rotates at the first rotation speed, wherein, in the detection process, the detection process executing unit controls the image forming unit to change a rotation speed of the agitator from the second rotation speed to the first rotation speed, and controls the determining unit to determine whether the cartridge should be replaced while the agitator is rotating at the first rotation speed.

19. The image forming device according to claim 18, wherein:

the determining unit also determines whether the time ratio calculated by the calculating unit is greater than a second threshold value, the second threshold value being lower than the first threshold value; and the detecting process executing unit executes the detection process if the time ratio is determined to be greater than the second threshold value while the image forming unit is in the second image forming mode.

20. The image forming device according to claim 19, wherein the reset unit resets the second value if the agitator rotates at the first rotation speed and if the time ratio is determined not to be greater than the second threshold value at the time of when the second value is determined to be greater than the predetermined count value.

* * * * *